US007564191B2

(12) United States Patent
Chang et al.

(10) Patent No.: US 7,564,191 B2
(45) Date of Patent: Jul. 21, 2009

(54) INVERTER HAVING SINGLE SWITCHING DEVICE

(75) Inventors: Shu-Ming Chang, Hsinhua (TW); Yu-Pei Huang, Hsinhua (TW); Shen-Yao Liang, Hsinhua (TW); Shwang-Shi Bai, Hsinhua (TW)

(73) Assignee: Himax Technologies Limited, Taiwan (CN)

( * ) Notice: Subject to any disclaimer, the term of this patent is extended or adjusted under 35 U.S.C. 154(b) by 0 days.

(21) Appl. No.: 11/430,452

(22) Filed: May 9, 2006

(65) Prior Publication Data

US 2007/0159114 A1 Jul. 12, 2007

(30) Foreign Application Priority Data

Jan. 11, 2006 (TW) ..... 95101088 A

(51) Int. Cl.
*H05B 37/02* (2006.01)

(52) U.S. Cl. ..... 315/209 R; 315/219; 315/276; 315/244; 315/307

(58) Field of Classification Search ..... 315/209 R, 315/219, 224, 225, 291, 276, 244, 307, DIG. 7; 363/19, 21.01, 21.02

See application file for complete search history.

(56) References Cited

U.S. PATENT DOCUMENTS

| | | | | |
|---|---|---|---|---|
| 5,028,846 | A * | 7/1991 | Lesea | 315/219 |
| 5,416,387 | A * | 5/1995 | Cuk et al. | 315/209 R |
| 5,485,361 | A * | 1/1996 | Sokal | 363/21.17 |
| 5,861,768 | A * | 1/1999 | Fujita et al. | 327/129 |
| 6,130,509 | A | 10/2000 | Kates et al. | |
| 6,198,236 | B1 | 3/2001 | O'Neill | |
| 6,639,366 | B2 * | 10/2003 | Bai | 315/219 |
| 6,674,247 | B1 * | 1/2004 | Mead et al. | 315/241 P |
| 7,161,305 | B2 * | 1/2007 | Chen | 315/209 R |
| 2004/0189216 | A1 * | 9/2004 | Choi | 315/291 |
| 2005/0258778 | A1 | 11/2005 | Chen | |
| 2006/0238140 | A1 * | 10/2006 | Chow et al. | 315/276 |
| 2007/0103093 | A1 * | 5/2007 | Hagen et al. | 315/291 |

* cited by examiner

*Primary Examiner*—Haissa Philogene
(74) *Attorney, Agent, or Firm*—The Webb Law Firm

(57) ABSTRACT

An inverter has an inductor, a capacitor, a switching device, a driving circuit and a transformer. A first terminal of the capacitor is connected to the inductor, and the switching device is connected between the first terminal of the capacitor and a ground terminal. The driving circuit is connected to the switching device, wherein the driving circuit is arranged to control the switching device to turn on or turn off; and a primary side of the transformer is connected between a second terminal of the capacitor and the ground terminal.

4 Claims, 2 Drawing Sheets

INVERTER HAVING SINGLE SWITCHING DEVICE

RELATED APPLICATIONS

The present application is based on, and claims priority from, Taiwan Application Serial Number 95101088, filed Jan. 11, 2006, the disclosure of which is hereby incorporated by reference herein in its entirety.

BACKGROUND

1. Field of Invention

The present invention relates to an inverter, and more particularly relates to an inverter having one switching device.

2. Description of Related Art

With the rapid development in technology, flat panel displays (FPD) with their advantages of high image quality, compact size, light weight, low driving voltage and low power consumption have become very popular for incorporation into electrical devices and have become the mainstream display apparatus. For example, the FPD can be implemented in portable TVs, mobile phones, video recorders, computer monitors, and many other kinds of consumer electronics.

In the FPD, the backlight module is used as the light source. An inverter in the backlight module is used to drive several cold cathode fluorescent lamps (CCFL), and to adjust the brightness of these CCFLs. FIG. 1 is a circuit diagram depicting an inverter of the prior art. The inverter 110 of the prior art comprises a capacitor 114, several switching devices 116*a*, 116*b*, 116*c* and 116*d*, a driving circuit 140 and a transformer 150. A power source 130 is connected to the capacitor 114 via the switching devices 116*a*, 116*b*, 116*c* and 116*d*. The switching devices 116*a*, 116*b*, 116*c* and 116*d* are individually connected to the driving circuit 140, wherein the driving circuit 140 is arranged to control the switching devices 116*a*, 116*b*, 116*c* and 116*d* to turn on or turn off. Furthermore, the capacitor 114 and the switching devices are individually connected to the two terminals of the primary side 119 of the transformer 150. The capacitor 165 is connected between a terminal of a secondary side 160 of the transformer 150 and a cold cathode fluorescent lamp (CCFL). Therefore, the inverter 110 transforms a direct current of the power source 130 into an alternating current, and thus lights up the cold cathode fluorescent lamp 170 connected to the secondary side 160 of the transformer 150, wherein the cold cathode fluorescent lamp 170 can be used as the light source of the display panel 180.

No matter if the inverter of FIG. 1 is full bridge or half bridge (not shown); it needs more than one switching device. Thus, the chip will be bigger and more complicated when using more switching devices. Therefore, an inverter with less switching devices can reduce the size of the chip and simplify the design of the driving circuit.

SUMMARY

It is therefore an aspect of the present invention to provide an inverter with a smaller chip size and a simple driving circuit.

It is therefore another aspect of the present invention to provide an inverter having one switching device.

According to one preferred embodiment of the present invention, the inverter has an inductor, a capacitor, a switching device, a driving circuit and a transformer. A first terminal of the capacitor is connected to the inductor, and the switching device is connected between the first terminal of the capacitor and a ground terminal. The driving circuit is connected to the switching device, wherein the driving circuit is arranged to control the switching device to turn on or turn off. Moreover, a primary side of the transformer is connected between a second terminal of the capacitor and the ground terminal, and a secondary side of the transformer is arranged to connect to and drive a cold cathode fluorescent lamp.

According to another preferred embodiment of the present invention, the inverter has an inductor, a capacitor, a switching device, a driving circuit and a transformer. A first terminal of the capacitor is connected to a first terminal of the inductor, and the switching device is connected between a second terminal of the inductor and a ground terminal. The driving circuit is connected to the switching device, wherein the driving circuit is arranged to control the switching device to turn on or turn off. Moreover, a primary side of the transformer is connected between a second terminal of the capacitor and the second terminal of the inductor, and a secondary side of the transformer is arranged to connect to and drive a cold cathode fluorescent lamp.

According to another preferred embodiment of the present invention, the inverter has a mid-tap transformer, a capacitor, a switching device and a driving circuit. The capacitor is connected between a first terminal and a second terminal of a primary side of the mid-tap transformer, and the switching device is connected between the first terminal of the mid-tap transformer and a ground terminal. The driving circuit is connected to the switching device, wherein the driving circuit is arranged to control the switching device to turn on or turn off. Moreover, there is a third terminal configured between the first terminal and the second terminal of the primary side of the mid-tap transformer, wherein the third terminal is connected to a positive electrode of a power source, and a secondary side of the transformer is arranged to connect to and drive a light source.

It is to be understood that both the foregoing general description and the following detailed description are examples and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
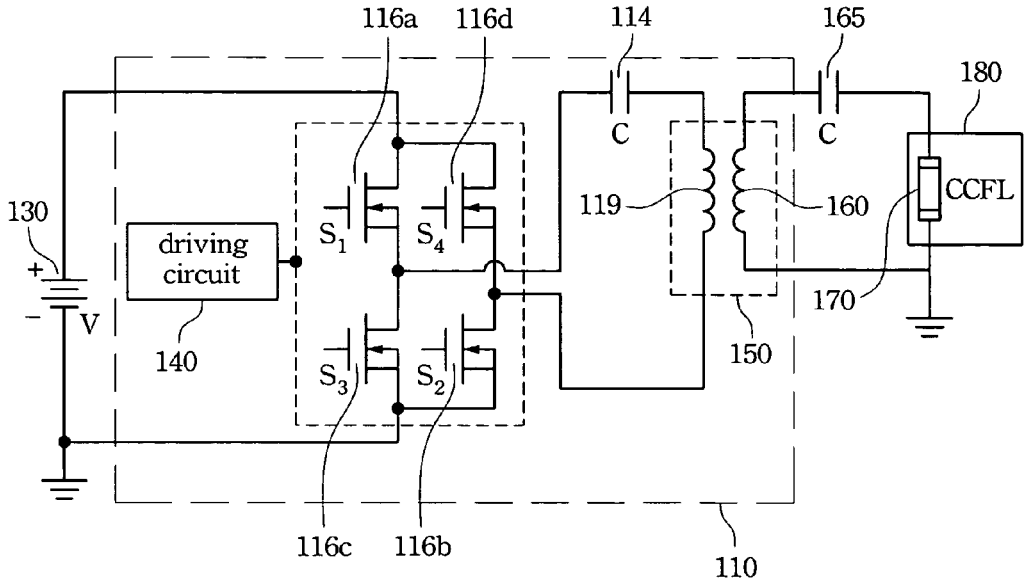
Fig. 1 (Prior art)
FIG. 1 is a circuit diagram depicting an inverter of the prior art.

Reference will now be made in detail to the present preferred embodiments of the invention, examples of which are illustrated in the accompanying drawings. Wherever possible, the same reference numbers are used in the drawings and the description to refer to the same or like parts.

Figure 2:
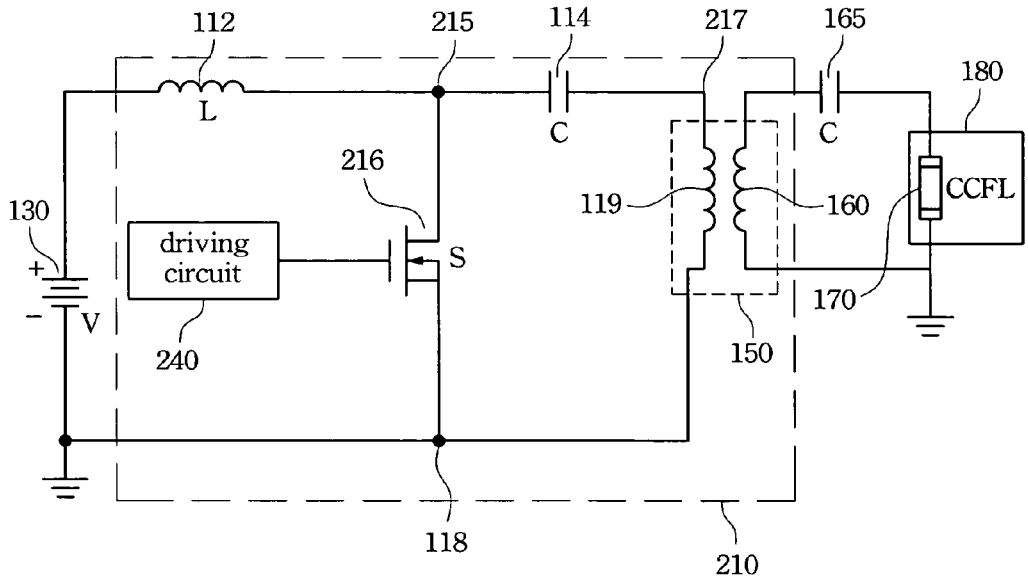
FIG. 2 is a circuit diagram depicting an inverter of one preferred embodiment of the present invention.

FIG. 2 is a circuit diagram depicting an inverter of one preferred embodiment of the present invention. According to one preferred embodiment of the present invention, the inverter 210 has an inductor 112, a capacitor 114, a switching device 216, a driving circuit 240 and a transformer 150. A first terminal 215 of the capacitor 114 is connected to the inductor 112, and the switching device 216 is connected between the first terminal 215 of the capacitor and a ground terminal 118. The driving circuit 240 is connected to the switching device 216, wherein the driving circuit 240 is arranged to control the switching device 216 to turn on or turn off. Moreover, a primary side 119 of the transformer 150 is connected between a second terminal 217 of the capacitor 114 and the ground terminal 118. A capacitor 165 is connected between a terminal of a secondary side 160 of the transformer 150 and a cold cathode fluorescent lamp 170. The cold cathode fluorescent lamp 170 is connected to another terminal of the secondary side 160 of the transformer 150 and the ground terminal. Therefore, the inverter 210 lights up the cold cathode fluorescent lamp 170 that can be used as the light source for the display panel 180.

In the embodiment described above, the inverter 210 is connected to a power source 130, and the inductor 112 is connected between the switching device 216 and the power source 130. Wherein a positive electrode of the power source 130 is connected to the inductor 112 and the negative electrode of the power source 130 is connected to the ground terminal 118. The power source 130 is used to supply the direct current to the inverter 210.

Figure 3:
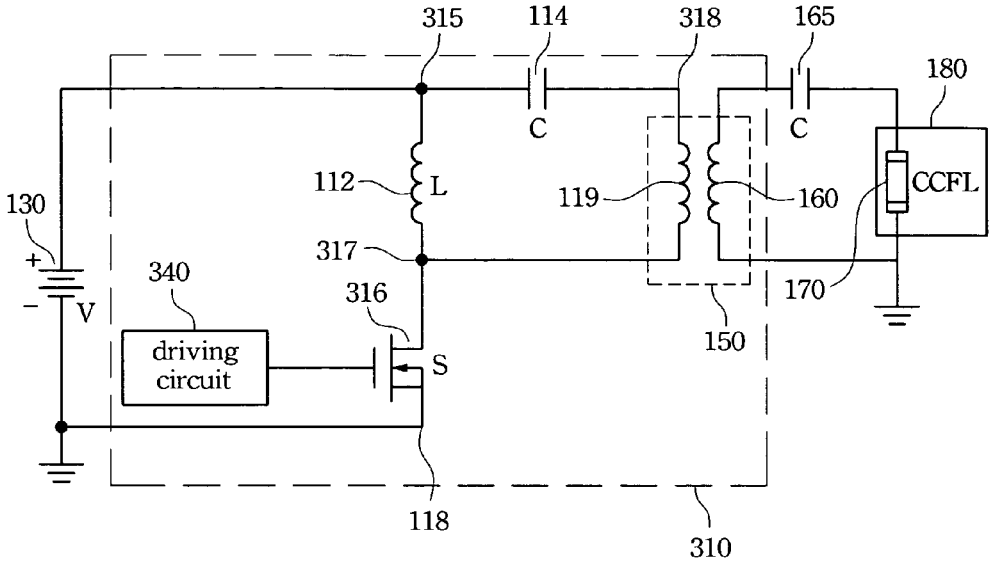
FIG. 3 is a circuit diagram depicting an inverter of another preferred embodiment of the present invention.

FIG. 3 is a circuit diagram depicting an inverter of another preferred embodiment of the present invention. According to another preferred embodiment of the present invention, the inverter 310 has an inductor 112, a capacitor 114, a switching device 316, a driving circuit 340 and a transformer 150. The capacitor 114 is connected to a first terminal 315 of the inductor 112, and the switching device 316 is connected between a second terminal 317 of the inductor 112 and a ground terminal 118. The driving circuit 340 is connected to the switching device 316, wherein the driving circuit 340 is arranged to control the switching device 316 to turn on or turn off. Moreover, a primary side 119 of the transformer 150 is connected between a second terminal 318 of the capacitor 114 and the second terminal 317 of the inductor 112. A capacitor 165 is connected between a terminal of a secondary side 160 of the transformer 150 and a cold cathode fluorescent lamp 170. The cold cathode fluorescent lamp 170 is connected to another terminal of the secondary side 160 of the transformer 150 and the ground terminal. Therefore, the inverter 310 lights up the cold cathode fluorescent lamp 170 that can be used as the light source for the display panel 180.

In the embodiment described above, the inverter 310 is connected to a power source 130. A positive electrode of the power source 130 is connected to the first terminal 315 and the negative electrode of the power source 130 is connected to the ground terminal 118. The power source 130 is used to supply the direct current for the inverter 310.

Figure 4:
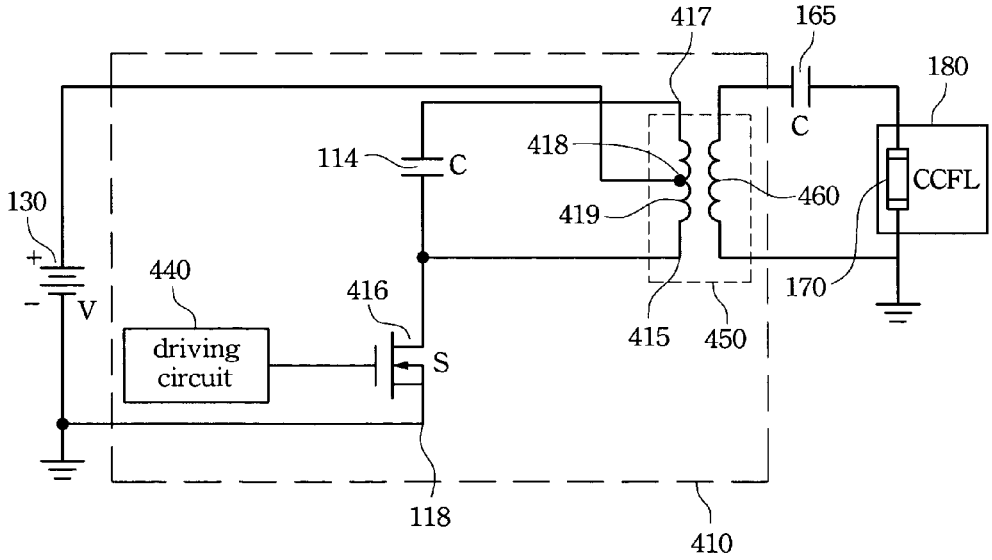
FIG. 4 is a circuit diagram depicting an inverter of another preferred embodiment of the present invention.

FIG. 4 is a circuit diagram depicting an inverter of another preferred embodiment of the present invention. According to another preferred embodiment of the present invention, the inverter 410 has a mid-tap transformer 450, a capacitor 114, a switching device 416 and a driving circuit 440. The capacitor 114 is connected between a first terminal 415 and a second terminal 417 of a primary side 419 of the mid-tap transformer 450, and the switching device 416 is connected between the first terminal 415 of the mid-tap transformer 450 and a ground terminal 118. The driving circuit 440 is connected to the switching device 416, wherein the driving circuit 440 is arranged to control the switching device 416 to turn on or turn off.

In the inverter 410 described in this embodiment, there is a third terminal 418 (mid-tap terminal) configured between the first terminal 415 and the second terminal 417 of the primary side 419 of the mid-tap transformer 450, wherein the third terminal 418 is connected to a positive electrode of a power source 130. A capacitor 165 is connected between an terminal of a secondary side 460 of the mid-tap transformer 450 and a cold cathode fluorescent lamp 170. The cold cathode fluorescent lamp 170 is connected to another terminal of the secondary side 460 of the mid-tap transformer 450 and the ground terminal. Therefore, the inverter 410 lights up the cold cathode fluorescent lamp 170 that can be used as the light source for the display panel 180

In these three embodiments described above, all inverters can be implemented using the common DVC-DC converter that accompanies a step-up transformer. Therefore, the inverters of these embodiments only need one switching device, thus the chip size can be reduced and the design can be simplified.

Otherwise, the switching devices 216,316 and 416 can be implemented using a transistor and a driving circuit in integrated circuits to achieve the required function.

The cold cathode fluorescent lamp 170 is suitable to be a light source for different display panels including liquid crystal display panels, plasma display panels, organic light-emitting diode display panels and low temperature polysilicon thin film transistor display panels.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inverter, comprising:

a mid-tap transformer comprising a primary side having a first and second terminal and a mid-tap terminal configured between the first and second terminal and connected to a power source;

a capacitor connected in parallel with the primary side of the mid-tap transformer, an end of the capacitor being connected to the first terminal of the primary side and the other end of the capacitor being connected to the second terminal of the primary side;

a single switching device connected between the first terminal of the mid-tap transformer and a ground terminal; and a driving circuit connected to the single switching device, wherein the driving circuit is arranged to only control the single switching device to turn on or turn off.

2. The inverter as claimed in claim 1, wherein the primary side of the mid-tap transformer comprises a third terminal configured between the first terminal and the second terminal, and the third terminal is connected to a positive electrode of a power source.

3. The inverter as claimed in claim 1, wherein the switching device is a transistor.

4. The inverter as claimed in claim 1, wherein a secondary side of the transformer is arranged to connect to and drive a light source.

* * * * *